United States Patent [19]

Huldén

[11] Patent Number: 4,674,945

[45] Date of Patent: Jun. 23, 1987

[54] COUPLING MEANS

[76] Inventor: Fritiof Huldén, Pl 3155, 660 60 Molkom, Sweden

[21] Appl. No.: 629,834

[22] PCT Filed: Nov. 15, 1983

[86] PCT No.: PCT/SE83/00399

§ 371 Date: Jul. 5, 1984

§ 102(e) Date: Jul. 5, 1984

[87] PCT Pub. No.: WO84/02152

PCT Pub. Date: Jun. 7, 1984

[30] Foreign Application Priority Data

Nov. 19, 1982 [SE] Sweden ..... 8206593
Feb. 18, 1983 [SE] Sweden ..... 8300909

[51] Int. Cl.[4] ..... E02F 3/81
[52] U.S. Cl. ..... 414/723; 37/117.5
[58] Field of Search ..... 414/723; 37/117.5; 172/272–274

[56] References Cited

U.S. PATENT DOCUMENTS

| | | | |
|---|---|---|---|
| 3,556,323 | 1/1971 | Heimmermann | 414/724 |
| 3,874,533 | 4/1975 | Montgomery et al. | 414/723 |
| 3,934,738 | 1/1976 | Arnold | 414/723 |
| 4,452,560 | 6/1984 | Coyle et al. | 414/723 |

*Primary Examiner*—Joseph E. Valenza
*Assistant Examiner*—Donald W. Underwood

[57] ABSTRACT

A coupling means for detachably coupling a working implement (1) to the operating arm of an excavating machine, said coupling means comprising an attachment means (25) supported by the operating-arm stick and operating cylinder and having a shaft (23) journalled horizontally at the stick, and a shaft (24) journalled on the operating cylinder, said coupling means also comprising an attachment means (20) supported by the implement (1) and comprising a coupling device (4, 5) and a locking device (21). According to the invention the attachment means (25) of the operating arm comprises two link arms (26, 27) journalled at the shafts (23, 24), each link arm having a free abutment portion (36) protruding as an extension of the link arm in backward direction from the shaft (24). The link arms (26, 27) and the implement attachment means (20) comprise counter members (39 and 16, 17) cooperating with each other under pressure, the locking device (11, 21) being arranged to exert pressure on the abutment portions (36) of the link arms (26, 27), thus moving the link arms (26, 27) in the direction of the coupling device (4, 5) through wedge and lever cooperation with said counter members (16, 17 and 39) and abutment portions (36) and pressing the operating arm attachment means (25) against the coupling device (4, 5) to produce a permanent, play-free joint between implement (1) and operating arm.

24 Claims, 13 Drawing Figures

Fig 2
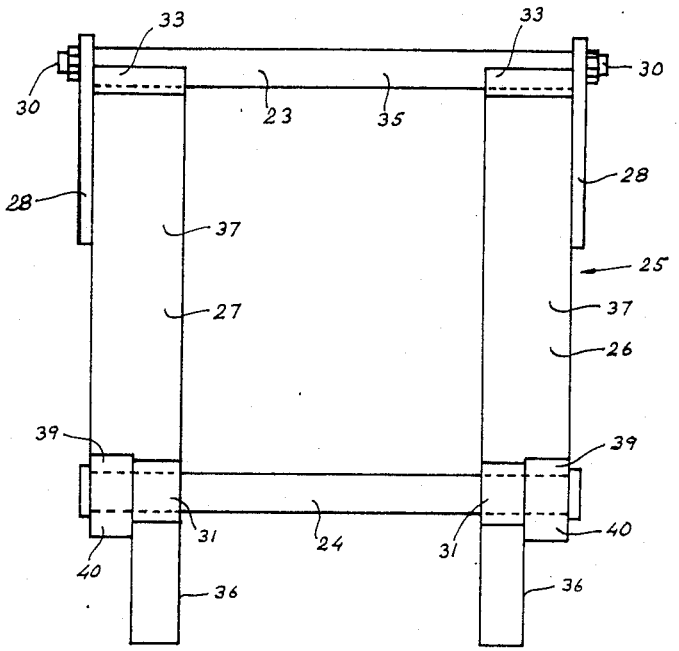
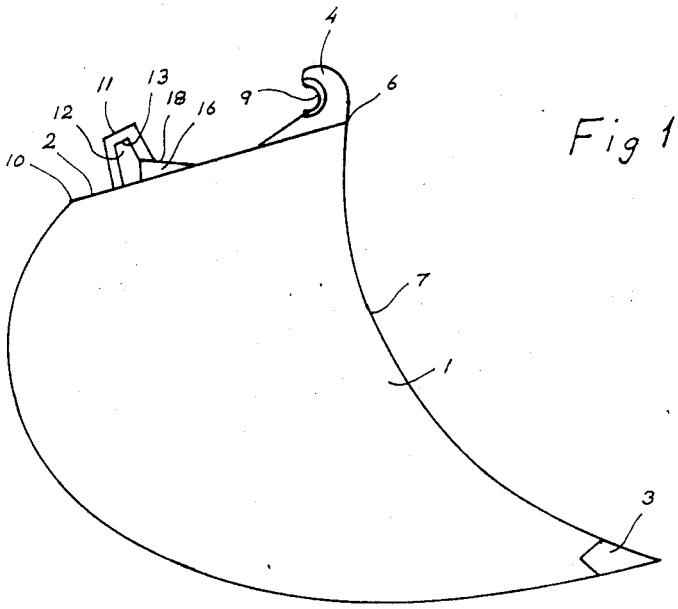
Fig 1

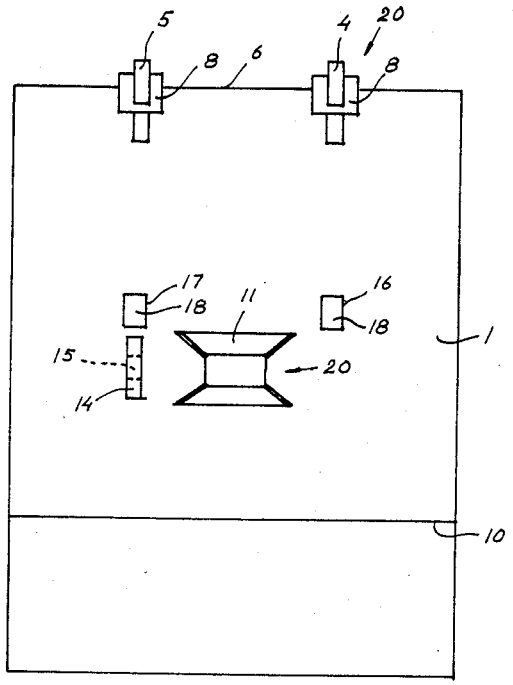
Fig 3
Fig 4
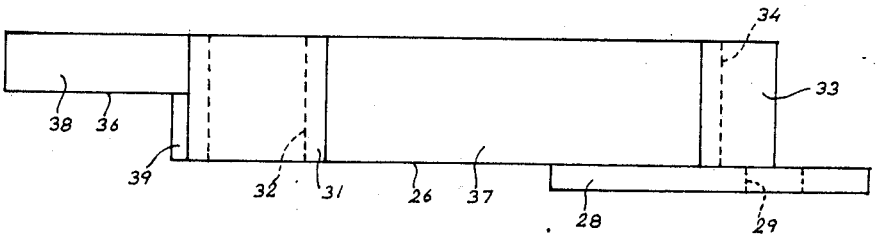

COUPLING MEANS

The present invention relates to a coupling means for detachably coupling a working implement to the operating arm of an excavating machine, said implement having an upper surface facing the operating arm, with a front edge facing the excavating machine.

Couplings of the type described above are known in a variety of embodiments, see for instance U.S. Pat. Nos. 3,269,570 and 3,556,323, swedish publications Nos. 216 635 and 8003255-0, and German publications No. 2 500 217. Although these can be called quick couplings and have the desired features in this respect, they have a number of other features rendering them not entirely satisfactory. A common feature of many such quick couplings is thus that, due to their solid construction, they increase the weight of the operating arm to such an extent that the weight of the implement itself must be correspondingly reduced in order to fulfill the inspection standards. This results in an undesired reduction in bucket volume. Further, the known couplings have attachment members of such a construction that they entail a considerable overall height or distance between operating arm and bucket, i.e. between the attachment members. Particularly the attachment member on the operating arm forms a substantial, solid, rigid intermediate piece between the operating arm and the attachment point of the bucket, this greatly contributing to said weight increase. Since the construction therefore requires more than two pivot centres it does not offer optimal conditions for the force transmission between operating arm and implement via the coupling. Poor breaking force is thus obtained in the bucket or other implement and the coupling is subjected to considerable stress. The bucket has a fixed geometry initially, i.e. without the quick coupling. However, due to the size of the known couplings, this geometry is altered in an undesired manner. To compensate for the deteriorated breaking force, it has been necessary to place the breaking shaft, i.e. the operating cylinder shaft, further from the stick shaft, but this instead results in decreased torque, thus reducing the pivotable distance of the bucket and deteriorating inwardly and outwardly pivoting movements of the bucket. Redesigning of the bucket usually results in the omission of the dome at the top which is used for force transmission between stick and bucket and to make the bucket as light and strong as possible. Known couplings cannot withstand diagonal breaking movements in vertical direction and breaking forces of the bucket unless the intermediate piece of the coupling which is thus rigid, is made relatively strong and bulky, resulting in increased weight. The couplings are therefore butt with respect to such diagonal breaking movements of the bucket and all forces must pass through the coupling. This becomes fatigued and will rupture if the forces become too great. At such diagonal breaking movements the load is reduced on two diagonal contact points in horizontal direction and correspondingly increased on two other of the four diagonal contact points at which the coupling is joined to the bucket, whereupon a gap occurs at the two first contact points.

The object of the present invention is to substantially reduce the problems mentioned above, and to provide in many respects a considerably improved coupling for excavating machine implements such as buckets, enabling the bucket to be simply and quickly mounted and dismounted from the operating arm of the excavating machine and which is entirely free from any bulky intermediate piece providing overall height between the lower shaft of the operating arm and the attachment point on the bucket. The coupling thus becomes correspondingly lighter and the volume or capacity of the bucket can be maintained as desired. The elimination of such an intermediate piece which increases the overall height of the coupling results in simplified construction as well as a considerable saving in material, with resultant financial advantages. The coupling according to the invention also offers improved conditions for the force transmission between bucket and operating arm, as well as making any alteration of the bucket geometry unnecessary. The coupling can also easily withstand diagonal breaking movements from the bucket despite the fact that it is more than considerably lighter than known couplings.

The invention provides a coupling means comprising an attachment means supported by the operating-arm stick and operating cylinder and comprising a shaft journalled horizontally at the stick, and also a shaft horizontally journalled directly or indirectly on the operating cylinder, said shafts being parallel and spaced a predetermined distance from each other, said coupling means also comprising an attachment means supported by the implement and comprising a coupling device and a locking device, by means of which coupling and locking devices the attachment means of the implement is arranged to be detachably coupled to the attachment means of said operating arm, said attachment means of the operating arm comprising a link means in the form of two link arms journalled at the end of said shafts by means of shaft supports included in the link arms, each link arm having a free abutment portion protruding as an extension of the link arms in backward direction from the operating cylinder shaft on the side of the operating cylinder shaft facing away from the stick shaft, said link arms and implement attachment means comprising counter members cooperating with each other under pressure, and said locking device being arranged to exert pressure on the abutment portions of the link arms, thus moving the link arms in the direction of the coupling device through wedge and lever cooperation with said counter members and abutment portions and pressing the operating arm attachment means against the coupling device to produce a permanent, play-free joint between said implement and operating arm. There is thus no rigid connections between the link arms and they can therefore move in their respective vertical planes upon vertical point stresses from the bucket or other implement. The link arm arrangement also eliminates the need for an intermediate piece which would increase the overall height of the coupling means.

A preferred embodiment of the invention is characterised in that the attachment means of the operating arm is arranged to be pressed against the coupling device by means of the link arms which are thus in direct contact with the coupling device. In this case the link arms are provided at the ends facing away from the abutment portions with free external support surfaces of predetermined shape, the coupling device being provided with free support surfaces of the same predetermined shape as the free support surfaces of the link arms for intimate surface cooperation therewith, whereupon the pressure from the locking device propagates through the links and is transmitted to the coupling device via said free support surfaces and that the distance for transmission of forces generated between implement and operating arm via the stick shaft and the coupling device of the implement are limited to a minimum equivalent to the wall thickness at said free external support surfaces, measured between these support surfaces and the opposing inner surface abutting the stick shaft. Besides the advantages mentioned above, such a coupling enables the operating arm attachment means to be easily adjusted to several different makes of excavating machines without altering the bucket attachment means. This means that one and the same bucket provided with an attachment means according to the invention can be quick-coupled to several different makes of excavating machines.

According to another embodiment of the invention, the stick shaft is arranged to be brought into direct engagement with said coupling device on the implement attachment means, the locking device being arranged to exert a pressure on the link arms, thus pressing the stick shaft directly against the coupling device to produce a permanent play-free joint between implement and operating arm. More specifically, each link arm is journalled on the shaft by means of a mounting plate provided with a hole and located outside the shaft, and is provided with an arc-shaped counter member which by means of a concave support surface abuts directly against the shaft which is thus pressed against the coupling device, the hole in the mounting plate being sufficiently large in relation to the diameter of the shaft pin to permit this transmission of pressure to the coupling device. This offers the advantage that the forces between stick and implement pass directly through the stick shaft to the coupling device, thus eliminating yet another point of play.

Additional advantages and objects will be apparent from the following description and claims.

The invention will be described further in the following, with reference to the accompanying drawings.

FIG. 1 shows schematically a bucket seen from the side provided on its upper side with parts of the attachment means of a coupling means according to one embodiment of the invention.

FIG. 2 shows an attachment means, seen from below, intended to cooperate with the attachment means part shown in FIG. 1 and forming a portion of said embodiment of the coupling means according to the invention.

FIG. 3 shows the bucket according to FIG. 1, seen from above.

FIG. 4 shows a link arm seen from above, which is included in the attachment means according to FIG. 2.

Figure 5:
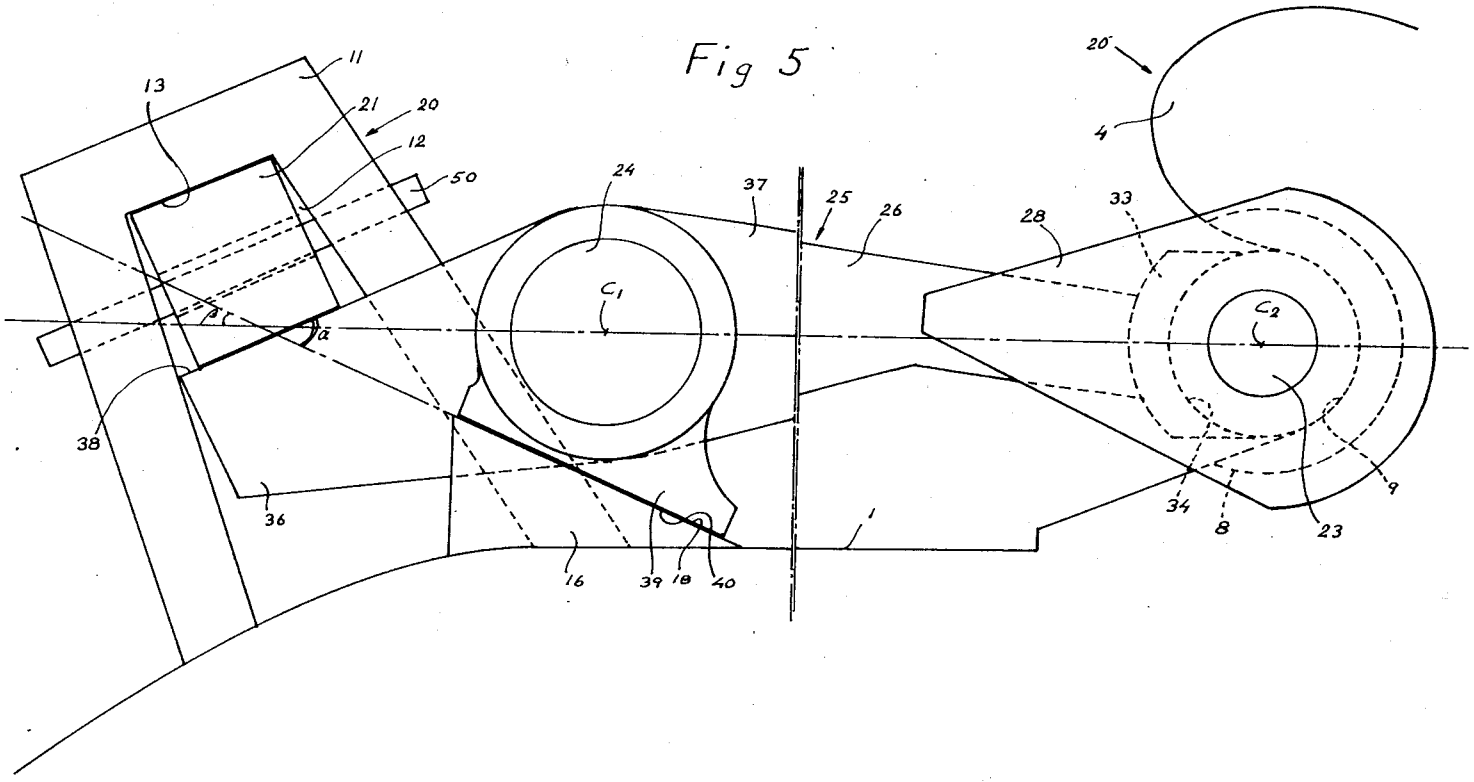
FIG. 5 shows the two attachment means according to FIGS. 2 and 3 connected together at the bucket.

With reference to FIG. 1 there is shown an implement in the form of a bucket 1 for a excavating machine in which the bucket is provided on its upper side 2, i.e. the side facing away from the digging edge 3, with an attachment means 20 (FIGS. 3 and 5) for a coupling means in the form of a quick coupling according to the invention. This bucket attachment means comprises a coupling device in the form of two hooks 4, 5, spaced from each other, which are welded to the upper side 2 at the front edge 6 of the bucket opening 7. Each hook comprises an elongate semi-cylindrical element 8, the elements being aligned with each other and parallel to the front edge 6 of the bucket. The hook elements are open towards the upper side of the bucket and form inwardly facing, i.e. facing away from the front edge 6, functional support surfaces 9 of concave or semi-cylindrical, predetermined shape for intimate cooperation with corresponding support surfaces on an attachment means on the operating arm of the excavating machine, as will be described below. The bucket attachment means 20 is provided with a locking device comprising a fixed, shackle-shaped part 11 which has a through-opening 12 and aligned parallel to said support surfaces 9. The shackle 11 is permanently secured to the bucket on the centre-line of the upper side. The opening 12 forms a flat, functional support surface 13 facing the upper side 2 of the bucket to cooperate with the corresponding support surface of a free tension pin 21 (see FIG. 5) as will be described below, said tension pin constituting a detachable part of the locking device. The locking device also includes a wedge support 14 (see FIG. 3) with a through-opening 15 aligned with the opening 12 of the shackle 11. The wedge support 14 may be shaped as an eye or a lug, as shown, or it may consist of two erect fingers with the opening between them. The parts 11, 14 of the locking device are thus secured to the upper side 2 of the bucket and arranged at a predetermined distance from the hooks 4, 5, in the vicinity of the rear edge 10 of the bucket.

The bucket attachment device 20 also comprises two shoulder-like counter members 16, 17 welded to the upper side 2, which are aligned with the hooks 4, 5 and arranged between the lock shackle 11 and the hooks 4, 5 in the vicinity of the lock shackle 11, i.e. at a considerable distance from the hooks 4, 5. Each counter member 16, 17 is provided with a flat, functional support surface 18, 18, these support surfaces lying in the same plane and being inclined inwardly in the direction of the hooks 4, 5 to cooperate with the corresponding support surfaces on the operating arm attachment means, as will be explained in the following.

The operating arm of the excavating machine comprises a stick (not shown) and a hydraulic operating cylinder (not shown) arranged on the front of the stick (facing away from the excavating machine), the stick being provided at its free end with a horizontal pin or shaft 23, pivotably carrying the bucket 1 and thus forming the centre of oscillation of the bucket, while the hydraulic cylinder either directly or indirectly via links is provided with a horizontally arranged pin or shaft 24 lying parallel to the stick shaft 23 and thus located in front of this and joined to the bucket 1 to obtain a controlled swinging movement of the bucket about the centre of the shaft 23.

Said shafts 23, 24 form parts of an attachment means 25 on the operating arm, which also includes a link means in the form of two parallel link arms 26, 27, each comprising a shaft support located at one end of the link arm, in the form of a mounting plate 28 with a horizontal hole 20 to receive the shaft end 30 of shaft 23 and a shaft support at a predetermined distance from said hole 29 in the form of a cylindrical sleeve 31 with a horizontal hole 32 to receive the shaft 24. Said shaft supports may be arranged with (i.e. as shaft bearing means) or without turning of the shaft and may include bushings. Each link arm is also provided or formed with an arc-shaped counter member 33 forming a functional, concave support surface 34 extending transversely, i.e. axially (in relation to the shaft 23), having the same radius and being arranged to abut the shaft 23, this also being provided with a function cylindrical support surface 35, also arranged to abut said function support surface 9 of the hooks 4, 5.

Each link arm comprises an abutment portion 36 exerting leverage which protrudes freely from the sleeves 31 in a backward direction from the shaft 24, i.e. in the direction of a backward extension of the link arms, forming an obtuse angle with the waist or main portion 37 of the link arm, located between the shafts 23, 24. On its upper side, facing away from the bucket 1, the abutment portion is provided with a functional, flat support surface 38, arranged to cooperate with a corresponding support surface of said free tension pin 21, as will be described below.

Furthermore, each link arm is provided immediately below the sleeves 31 with a counter member 39 designed with a functional, flat support surface 40 arranged to abut and cooperate in a wedge-like manner with said functional support surface 18, 18 of the counter member 16, 17 on the bucket attachment means. Said functional support surfaces 18, 18; 40 incline towards the hooks 4, 5 and have the same inclination. This inclination is such that in their extended planes the support surfaces of the counter members form an acute angle $\alpha$ with the support surfaces 38 of the abutment portions. The angle $\alpha$ may be about 35°–85°, preferably 50°–60°, in order to achieve the required wedge-effect when the link arms are clamped between the fixed locking shackle 11 and the hooks 4, 5 via the counter member 16, 17 with the aid of the loose tension pin 21 of the locking device. The support surfaces 18, 18; 40 are preferably inclined so that in extended plane they form an acute angle $\beta$ of from about 10° to about 65°, suitably 30°–60°, preferably about 45°, with said centre plane $C_1$-$C_2$. The inclination of the support surfaces 18, 18; 40 of the counter members 16, 17; 39, i.e. the angle $\beta$ should not be too large, i.e. not above about 65°, as this might cause unfavourable influence from the stroke of the hydraulic cylinder, on the stick shaft and the support surfaces at this part of the joint.

Figure 7:
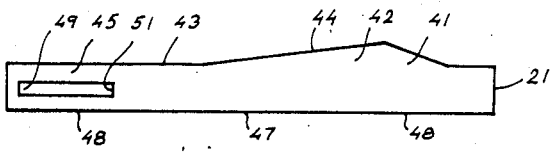
FIG. 7 shows a side view of a locking pin included in the bucket attachment means.
Figure 6:
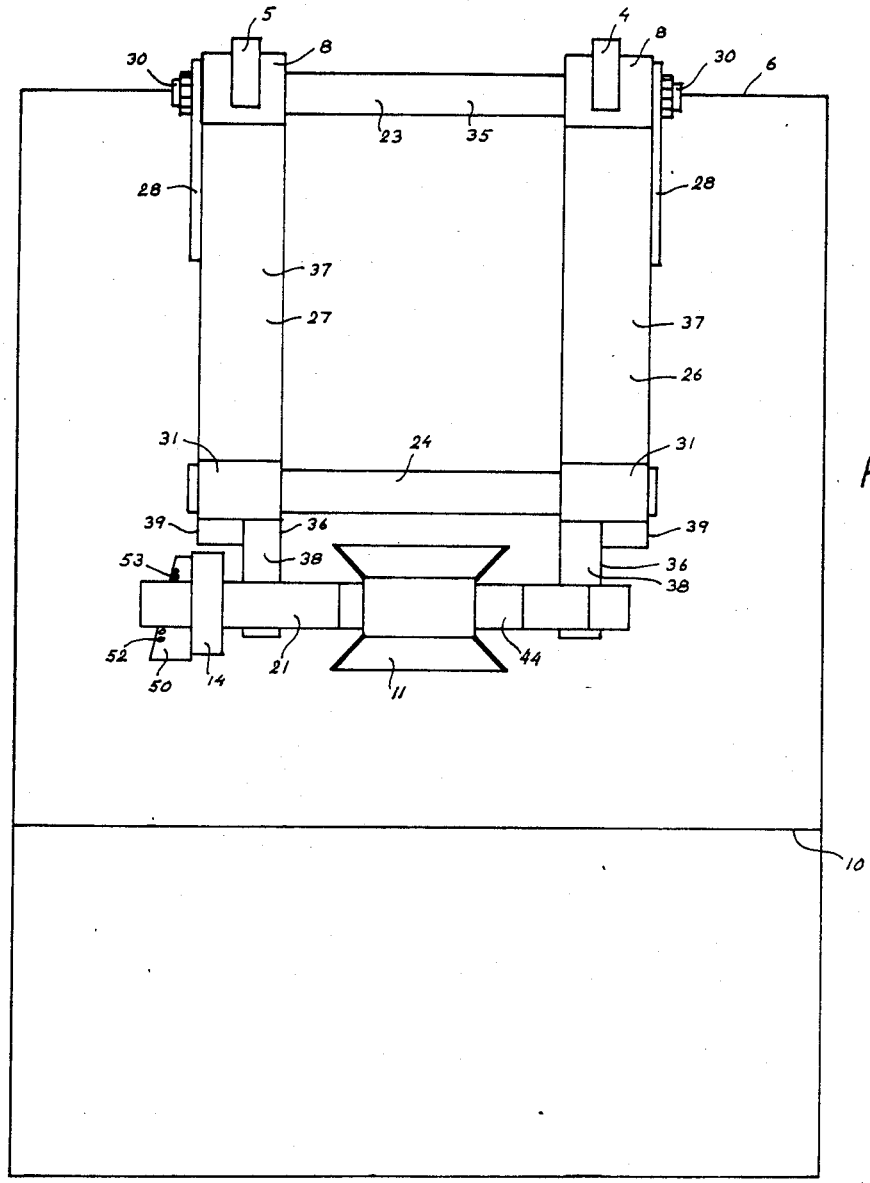
FIG. 6 shows the coupling means according to FIG. 5, seen from above.

The mentioned tension pin 21, shown in more detail in FIG. 7 and constituting the loose part of the locking device of the bucket attachment means, are elongate with rectangular cross-section increasing from substantially the middle in the direction of the rear part 41 of the tension pin, forming a wedge section 42 provided on the upper side of the tension pin with a functional, flat support surface 44. The lower side 47 of the tension pin forms a functional support surface 48. The tension pin is also provided with a transverse, rectangular hole 49 in its front section 45, the hole 49 fitting a locking wedge 50 (FIG. 6). The inner edge 51 of the hole is located so far in that the locking wedge does not come into contact with this edge once a final, play-free locking position has been achieved, but only with the wedge support 14. The locking wedge is provided with a plurality of small apertures 52 so that the wedge can be held in place by a peg 53 inserted in the hole 52 nearest the tension pin once said locking position has been achieved. The inner support surface 13 of the locking shackle has the same inclination as the support surface 44 of the tension pin 21 in order to achieve the desired wedge-effect.

The bucket is coupled extremely quickly and easily to the operating arm of the excavating machine by means of the described attachment means. The first step is to adjust the operating arm so that the stick shaft 23 is brought into direct engagement with the hooks 4, 5 of the bucket, after which the counter member 16, 17 of the bucket and the counter member 39 of the operating arm attachment means, by connection of the hydraulic cylinder, are brought into alignment with each other at said support surfaces 18, 18; 40. In this starting position the abutment portions 36 of the link arms 26, 27 are sufficiently far beneath the support surface 13 of the locking shackle 11 for the elongate tension pin 21 to be passed without obstruction into the passage formed between the support surfaces 13 and 38 with said abutment portions 36 in light contact with the lower side 47 of the tension pin. With the aid of a tool, e.g. a sledgehammer, the tension pin 21 is then driven into said fixed locking shackle 11 until a play-free joint is obtained. The locking wedge 50 is then inserted into the hole 49 of the tension pin, hammered in as a wedge and locked in its final position with the peg 53. Dismantling is performed in an equally simple and quick manner in the reverse order. When the tension pin 21 is driven in a permanent wedge-force is produced between the abutment portions 36 of the link arms and the locking shackle 11 of the bucket attachment means at the surfaces 13, 44 and 38, 47 producing a leverage on abutment portions 36. This wedge-force is transmitted to the slidingly cooperating counter members 16, 17; 39 so that support surfaces of the counter member 39 slide down along the support surfaces 18, 18 of the counter member 16, 17 of the bucket attachment means. This sliding movement produces a permanent wedge-force which results in increased abutment of the shaft 23 against the hooks 4, 5 so that a permanent joint is obtained, entirely without clearance, this abutment force against the hooks 4, 5 deriving from said wedge-forces transmitted via the counter members 16, 17; 39.

Since the pressure from the link arms on the coupling means, initiated by the tension pin 21, is allowed to pass through the stick shaft 23, the pivoting of the bucket about the operating arm stick is such that the forces from the stick are transmitted directly to the bucket via the stick shaft and the bucket coupling members (hooks 4, 5). The play-free joint obtained according to the invention will be subject to very little wear and such wear as does occur will not in any case give rise to clearance since it is automatically and immediately compensated by the inherent wedge-force so that the joint remains play-free. In other words, the joint is self adjusting.

The tension pin 21 provides effective mechanical locking which is achieved manually in the embodiment shown. However, if desired, the locking may be achieved hydraulically or pneumatically.

The hooks can be welded directly onto the top of the bucket, as can also the locking shackle 11, wedge support 14 and counter members 16, 17, to give the least possible increase in the weight of the bucket. Alternatively at least the locking shackle 11, wedge support 14 and counter members 16, 17 may be welded to a plate which is in turn welded to the top of the bucket as a unit. If desired, the hooks may also be welded to said plate.

The locking device can be designed in a variety of ways within the scope of the invention. For instance, the central locking shackle may be replaced by two locking eyes, each arranged in line with one of the counter members 16, 17 and one of the hooks 4, 5 and having aligned openings to receive a wedge-like tension pin. In this case the openings of both locking eyes are provided with inclined support surfaces so as to cooperate with the tension pin which is then provided with two wedge sections the same distance apart as the locking eyes, the rear wedge section being higher (larger cross-section) than the front wedge section, and the openings in the locking eye similarly of the different size to enable the tension pin to be inserted in wedge position. In order to compensate for wear on the support surfaces, the support surfaces of the locking eyes may be effected on separate plates or the like which can be adjusted by means of a screw.

As is seen, the design of the attachment means 20, 25 and their unique fit to each other, causes no building height between operating arm and bucket, i.e. the pivot axis of the bucket on the operating arm is at the same level it would be at if the operating arm were secured to the bucket in conventional manner, e.g. by an attachment lug, without the use of a quick coupling.

Figure 11:
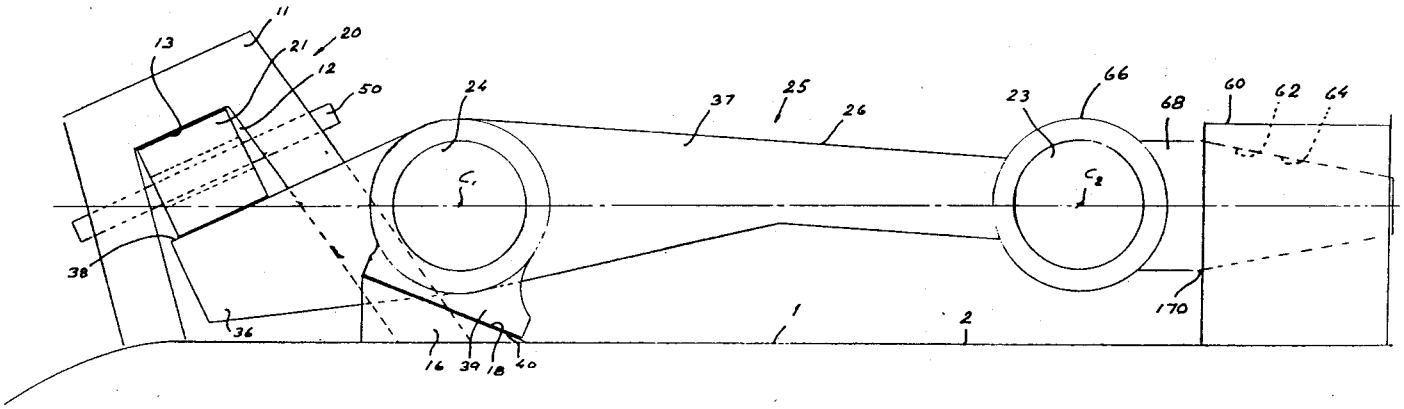
FIGS. 11 and 12 show another embodiment of a quick coupling arrangement in which the stick shaft is in indirect engagement with the coupling device of the bucket.
Figure 12:
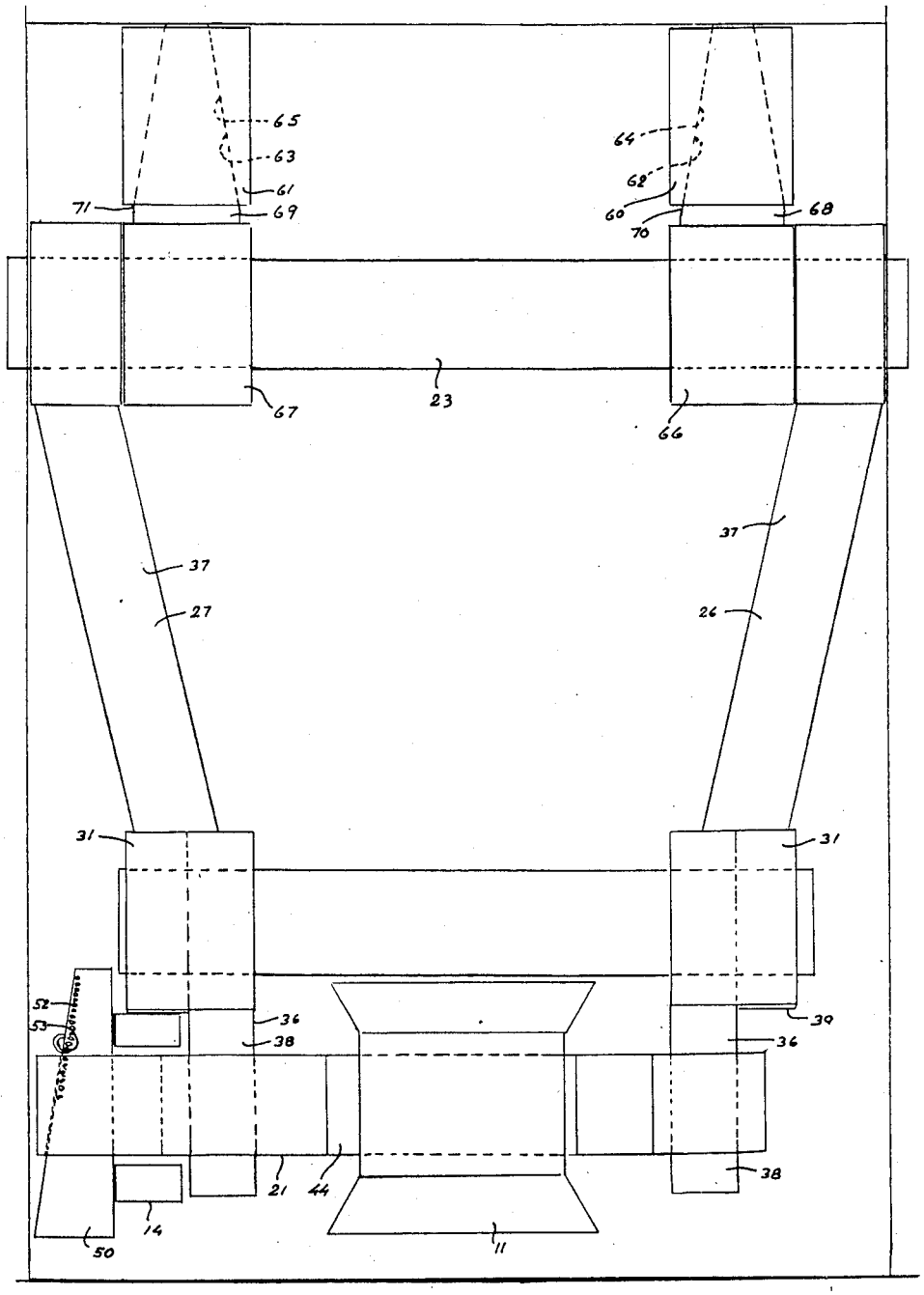

The valuable effect achieved by eliminating the building height of the quick coupling, while at the same time making the coupling light, can also be achieved by allowing the stick shaft to be in indirect engagement with the coupling device of the bucket (or other implement) in which case the pressure from the tension pin to the coupling device will still pass through the shaft 23. Such an embodiment is shown in FIGS. 11 and 12 wherein parts which substantially correspond to parts of the embodiment shown in FIGS. 1 to 6 at the same reference designations. The bucket attachment means include a coupling device in the form of two coupling elements 60,61 located at predetermined distance from each other, each having an aperture 62,63 facing the stick shaft 23. This aperture is conical so that an inner conical support surface is formed. The stick shaft 23 is here provided with an intermediate connection member in the form of two cylindrical sleeves 66, 67, each with a conical pin 68,69 corresponding to said apertures 62,63, forming conical support surfaces 70,71. The pins can be turned on the shaft 23 by means of the sleeves 66,67 in order to permit said pressure transmission via the shaft, and facilitate their insertion into the apertures 62,63 whereby the pins 68,69 are arranged to assume a coupling position in which they protrude in a direction away from the operating cylinder shaft 24. The pins form a right-angle with the stick shaft 23 and, due to the sleeves 66,67, have a centre of pivot coinciding with the shaft centre. In said coupling position the centre line of the pins 68,69 should preferably coincide with a centre plane $C_1$-$C_2$ through the centre of the shafts. As with the embodiments described above, the locking device is arranged to exert a pressure on the link arms 26,27, thus pressing the stick shaft 23 against the coupling elements 60,61 via their ends to produce a permanent play-free joint. According to an alternative embodiment the coupling device is in the form of two hooks, as described earlier, whereas the stick shaft has an intermediate connection member in the form of two cylindrical sleeves to cooperate with the hooks.

Figure 8:
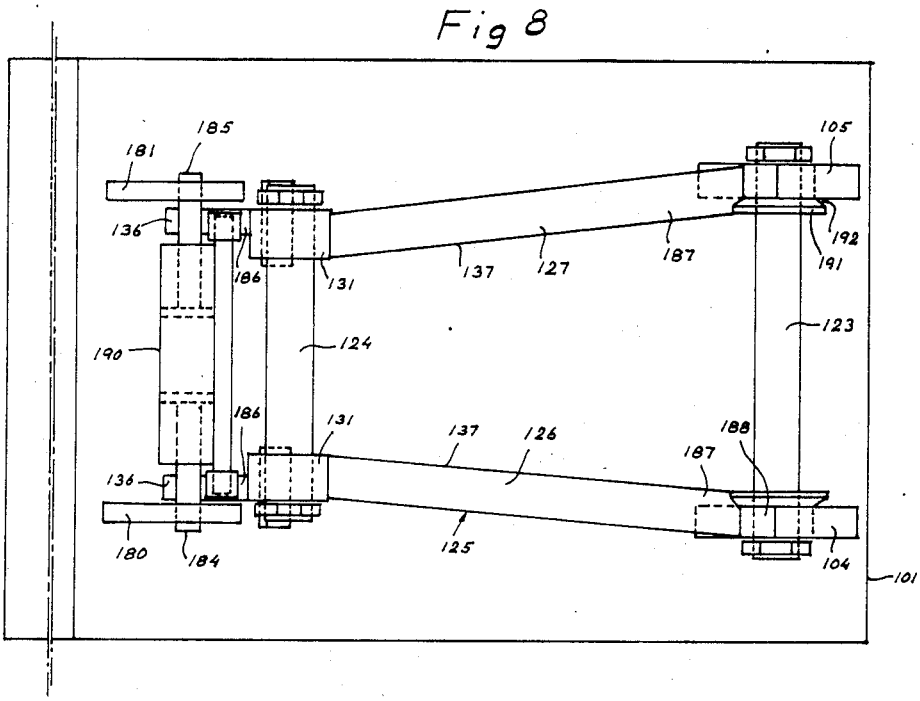
FIG. 8 shows schematically from above a bucket with a coupling means according to another embodiment of the invention.
Figure 9:
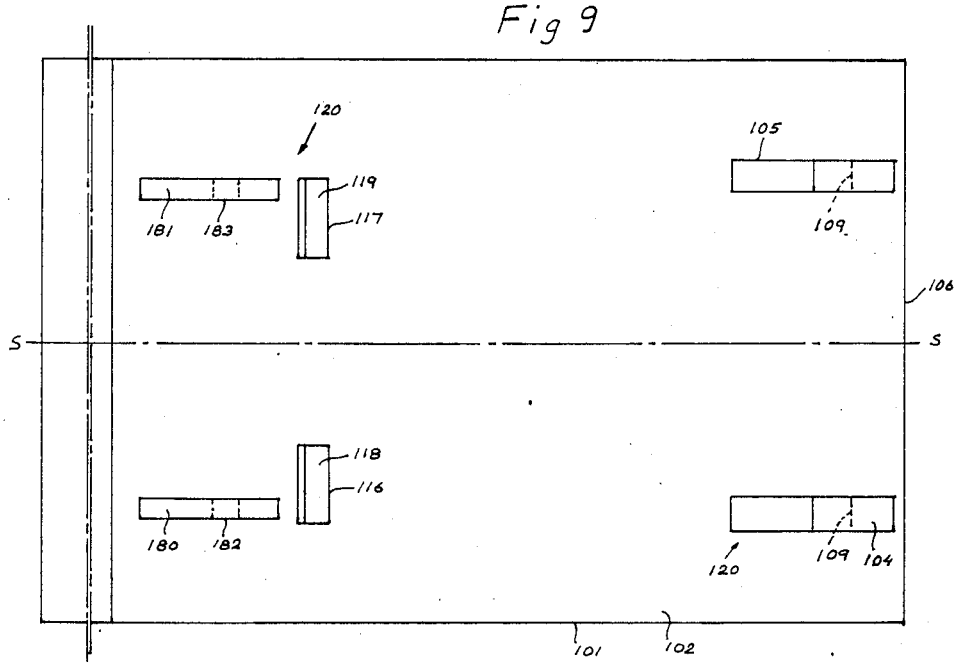
FIG. 9 shows the bucket according to FIG. 8, and the bucket attachment means of the coupling means.
Figure 10:
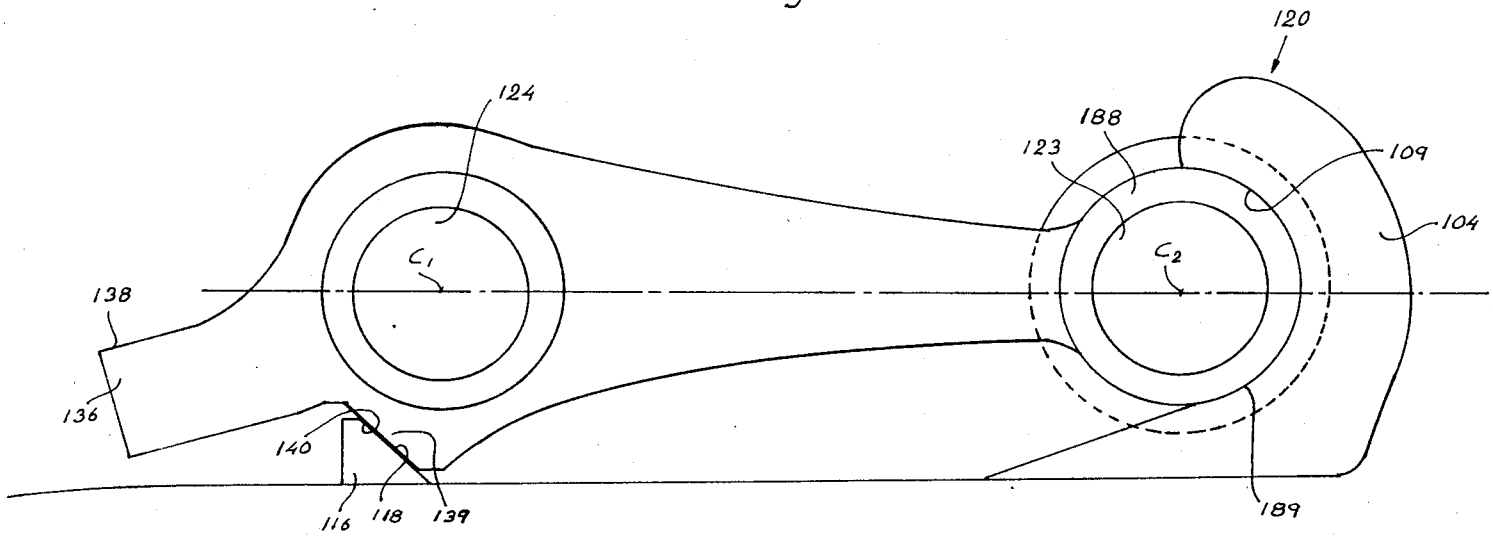
FIG. 10 shows schematically parts of the coupling means according to FIG. 8, seen from the side.

FIGS. 8–10 show schematically another embodiment of the coupling means according to the invention. The bucket 101 of an excavating machine is provided on its upper side 102, facing away from the digging edge, with an attachment means 120 for a quick coupling according to the invention. This bucket attachment means comprises a coupling device in the form of two inwardly facing hooks 104, 105 spaced from each other, welded to the top 102 of the bucket at the front edge 106 of its opening. The inwardly facing hooks are provided with function support surfaces 109, concave or semi-cylindrical in shape, with predetermined radius for intimate cooperating with corresponding support surfaces on an attachment means of the operating arm of the excavating machine, as will be described below. The two support surfaces are aligned and perpendicular to the plane of symmetry S—S of the bucket.

The coupling means is provided with a locking device comprising two locking eyes 180, 181 with aligned openings 182, 183 to receive wedged tension pins 184, 185 in the form of pressure rods in a double-operating hydraulic cylinder 190. The openings of the locking eyes have inclined support surfaces in order to cooperate with corresponding inclined surfaces in the tension pins in wedge-like manner. The bucket attachment means is also provided with two shoulder-like counter members 116, 117 welded to the top 102 and located between the locking eyes 180, 181 and hooks 104, 105, in the vicinity of the former. Each of the counter members 116, 117 has a plane functional support surface 118, 119 lying in the same plane and inclined inwardly in the direction of the hooks 104, 105 to cooperate with corresponding surfaces of the operating arm attachment means as will be described below.

As described earlier, the operating arm of the excavating machine includes a stick (not shown) and a hydraulic operating cylinder (not shown) arranged on its front side (facing away from the excavating machine). At its free end the stick is provided with a horizontal pin or shaft 123 on which the bucket 101 pivots. The shaft 123 thus forms the pivot centre of the bucket while said hydraulic cylinder, either directly or indirectly via links, is provided with a horizontal pin or shaft 124 which is parallel to the stick shaft 123 and thus located in front of this and indirectly connected to the bucket 101 to obtain a controlled swinging movement of the bucket about the centre of the shaft 123.

Said shafts 123, 124 form parts of an attachment means 125 on the operating arm, this attachment means also including a link means in the form of two parallel link arms 126, 127, each provided with a locking end portion 186 and a coupling end portion 187. At the locking end portion 186 of each link arm, at a predetermined distance from the coupling end portion 187, are shaft support means in the form of a cylindrical sleeve with a horizontal aperture to receive the shaft 124 and an abutment portion 136 exerting leverage, which protrudes from the sleeve 131 in backward direction from the shaft 124, i.e. in a backward extension of the link arm, forming an obtuse angle with the waist or main part 137 of the link arm located between the shafts 123, 124. On its upper side, facing away from the bucket, the abutment portion is provided with a functional, flat surface 138 arranged to cooperate with a corresponding support surface of the tension pin 184, 185, respectively. The hydraulic cylinder 190 is supported by the link arms 126, 127 by means of a rod or the like, the free ends of which rest freely with clearance in sleeves (FIG. 8). The rod is thus not permanently joined to the link arms and these can therefore move freely in the event of strain between bucket and operating arm. The hydraulic cylinder can thus still be considered to constitute a part of the locking device for the implement attachment means.

Furthermore, each link arm is provided with a counter member 139 within its locking end portion, designed with a functional, flat support surface 140, designed to abut said functional support surfaces 118, 119 of the counter members 116, 117 of the bucket attachment means, cooperating to produce a wedge effect. These functional support surfaces 118, 119 and 140 incline towards the hooks 104, 105 with the same inclination. The inclination is such that an extension of the support surfaces forms an acute angle with the abutment portion support surfaces 138, this angle having the values specified for the first embodiment described. The support surfaces 118, 119 and 140 are preferably inclined so that their extensions form an acute angle with a centre plane extending through the centres of the shafts 123, 124, said angle having the values specified for the first embodiment described. The counter member 139 is arranged immediately below the sleeves 131.

Each link arm 126, 127 is also provided at its coupling end portion with a shaft support means in the form of a sleeve 188 having a horizontal aperture to receive the shaft 123. Said shaft support member may be arranged with or without pivoting of the shaft (i.e. as shaft bearing means or not) and may include bushings. The sleeve is preferably cylindrical and provided externally with a functional concave or semi-cylindrical support surface 189 extending transversely or axially (in relation to the shaft 123) and having a predetermined radius corresponding to the radius of the semi-circular support surfaces 109 of the hooks 104, 105, so that maximum contact is obtained between these surfaces. The support surfaces of the hooks preferably encompass the greatest possible sector angle, i.e. 180°, as can be seen in FIG. 10. The support surface 189 of the sleeve 188 is thus immediately outside the shaft 123 as close as the wall thickness of the sleeve permits, suitably about 15 mm. The support surface 189 is also located in line with and on both sides (symmetrically) of the centre plane through the centres $C_1$, $C_2$ of the shafts 123, 124 and on the side of the shaft 123 facing away from the link arms.

In the embodiment according to FIGS. 8 to 10, the force from the tension pins 184, 185 is transmitted to the hooks 104, 105 via counter members 139, shaft 124, link arms 126, 127 and their sleeves 188 abutting directly against the hooks. The shaft 123 is thus not affected by this pressure load. Thus, when stresses occur due to the movement of the bucket with the aid of the operating arm, pressure forces occur externally on the sleeves 188, i.e. on the support surfaces 189, towards or away from the support surface 109 of the hooks and on the inside of the sleeves towards or away from the shaft 123. The joint is entirely play-free at the support surfaces 109 of the hooks.

In order to facilitate insertion of the transverse sleeves 188 in the hooks, the former are provided with a conical ring 191, the conical surface 192 serving as a guide surface. The described embodiment of the operating arm attachment means permits simple modification for several different types of excavating machines and the bucket is provided with an attachment means which fits all these modifications. The modifications are due to variations in the stick width in different types of excavating machines and entail the distance between the sleeves on shaft 123 being adjusted to correspond to the stick width. In some embodiments the rings are removed. The common bucket attachment means is adjusted for these modifications by merely extending the counter members 116, 117 towards or away from each other, thus permitting different positions are possible on the abutment portions at the sleeves 131.

The cooperating arc-shaped support surfaces of the shaft support sleeves 188 and hooks 104, 105 enable the bucket to be pivoted before the locking device has been applied during assembly.

Figure 13:
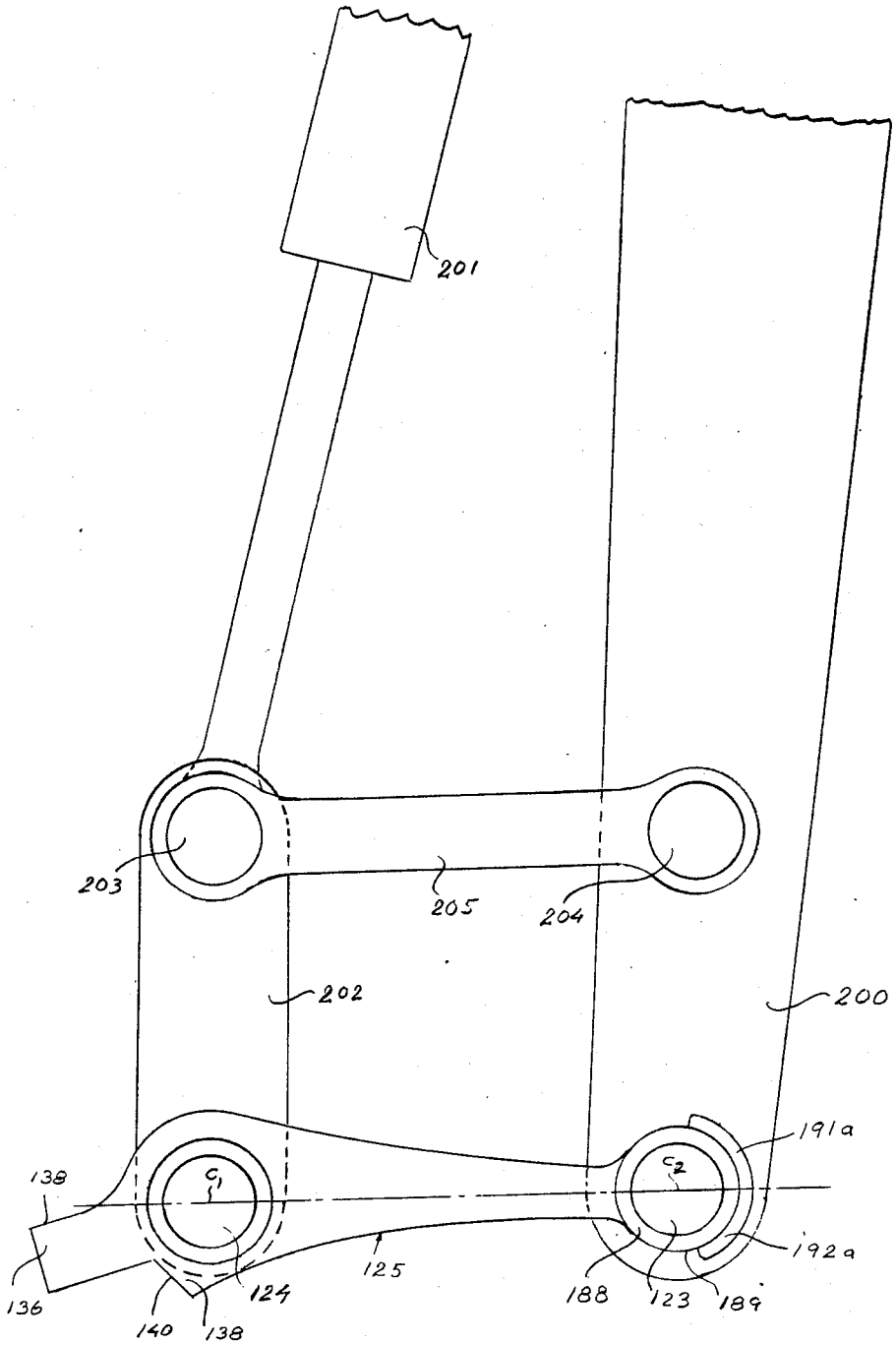
FIG. 13 shows a modification of the coupling means of FIGS. 8 to 10.

FIG. 13 shows schematically an embodiment of an operating arm attachment means 125 similar to that shown in FIGS. 8 and 10 with the exception that the guide means on each link arm is in the form of a circular arc member **191*a* thus being a part of the conical ring 191 shown in FIGS. 8 and 10. The circular arc member 191*a* has an inclined guide surface 192*a* in relation to the coupling device and is arranged to cooperate with the coupling device to facilitate connecting of the operating arm attachment means to the coupling device. FIG. 13 also shows the lower part of the operating arm of the excavating machine. The operating arm comprises a stick 200 and a hydraulic operating cylinder 201 arranged on the front of the stick 200. The stick 200 is provided at its free end with said pin or shaft 123 pivotably carrying the bucket and thus forming the centre of oscillation of the bucket. The hydraulic cylinder 201 is indirectly via links 202 provided with said horizontally arranged pin or shaft 124 which is parallel to the stick shaft 123. The links 202 are pivotable on horizontal pin 203. Links 204 are pivotable on said pin 203 to connect the hydraulic cylinder 201 to the stick 200 via a horizontal pin 205**.

As can be seen from the embodiments shown in the drawings, the coupling devices 4, 5; 104, 105, seen in assembly position, are arranged in a straight line with the shafts 23, 24; 123, 124 so that they are intersected by the centre plane $C_1$–$C_2$ coinciding with the shaft centres and consequently also passing through the shaft support means of the stick shaft. Such an arrangement, beneficial in many respects, combined with link arms has not been used previously in quick couplings for implements of this type. In both the shown embodiments the centre line $C_2$ of the stick shaft coincides with that of the radius of the semi-cylindrical support surfaces of the hooks. The link arms are thus unloaded since the forces from bucket to stick and vice versa are transmitted by the shortest route. The constantly occurring strokes are not therefore transmitted further through the link arms. These are thus not damaged and can be made light. The link arms may preferably be bent upwards, following the dome-shape of the bucket, thus enabling the desired dome to be retained. The embodiment of the operating arm attachment means shown in FIGS. 8 and 10 can be used, if desired, to bring the stick shaft into direct engagement with the hooks on the bucket. In this case, corresponding minor adjustments are made on the link arms and their shaft support means so that they and the stick leave parts of the shaft free for engagement with the hooks. A coupling according to the present invention has the following advantages: (a) It has extremely low weight (about 30 kgs for a machine up to 14 tons) and therefore saves material, as well as being light to use and assemble. (b) The construction is simple, making it quick and easy to fit the bucket to the excavating machine. (c) It has no intermediate piece which would cause building height and increased weight. (d) The low weight does not necessitate altering the bucket volume. (e) It enables the force-absorbing dome of the bucket to be retained, thanks to the link arm construction, since the link arms may be arc-shaped to suite the dome. (f) It entails improved, even optimum conditions for the force transmission between bucket and operating arm and the link arms are not affected to any noticeable extent since the forces are transmitted directly to the hooks from the stick and vice versa via the stick shaft and sleeve, if used, abutting the hooks. (g) Thanks to its design and improved force transmission, the stipulated geometry of the bucket can be retained. (h) It withstands diagonal breaking movements of the bucket since the link arms make the coupling resilient, there being no rigid, stiffening joint between them and they can therefore move freely up and down at their end portions at the four contact points with the bucket, independently and in relation to each other. They will therefore follow the diagonal breaking movements from the bucket when this is temporarily deformed and becomes distorted by lateral stresses. (i) It maintains a play-free joint between implement and operating arm at the contact points between operating arm attachment means and hooks even when the link arms follow the diagonal breaking movements of the bucket. (j) It is self-adjusting with respect to any slight wear which may occur at the contact surfaces, and a play-free joint is thus always guaranteed. (k) According to a preferred embodiment, it can easily be modified to fit many different types of excavating machines.

What I claim is:

1. A coupling means for detachably coupling a working implement to an excavating machine operating arm having a stick and and an operating cylinder, said implement having an upper surface facing the operating arm, with a front edge facing the excavating machine, said coupling means comprising an operating arm attachment means supported by the operating-arm stick and operating cylinder and comprising a stick shaft journalled horizontally at the stick, and also a cylinder shaft horizontally journalled to the operating cylinder, said shafts being parallel and spaced a predetermined distance from each other, said coupling means also comprising an implement supported attachment means and comprising a coupling device and a locking device, by means of which coupling and locking devices the implement supported attachment means is arranged to be detachably coupled to the operating arm attachment means, said operating arm attachment means comprising link means in the form of two link arms, each mounted for independent movement relative to the other, one of the link arms being journalled by shaft supports included in the link arm to one of the, same facing, ends of said shafts and the other link arm being independently journalled by its shaft supports to opposite ends of said shafts to define an operating arm attachment means devoid of additional bracing, each link arm having a free abutment portion protruding as an extension of the link arms in backward direction from the operating cylinder shaft on the side of the operating cylinder shaft facing away from the stick shaft, said link arms and implement supported attachment means comprising counter members having mating surfaces downwardly inclined toward said coupling device, said counter members cooperating with each other under pressure, said locking device in operation exerting pressure on the abutment portions of the link arms to move the link arms in the direction of the coupling device by virtue of the pressure in turn applied to the mating downwardly inclined surfaces during said pressure application on the abutment portions thereby to press the operating arm attachment means against the coupling device to produce a permanent, play-free joint between said implement and operating arm.

2. A means according to claim 1 wherein said attachment means of the operating arm is arranged to be pressed against said coupling device by means of said link arms which are thus in direct contact with the coupling device.

3. A means according to claim 1 wherein said attachment means of the operating arm is arranged to be pressed against the coupling device by means of said stick shaft, which is thus in direct contact with the coupling device.

4. A means according to claim 1 wherein said attachment means of the operating arm is arranged to be pressed against the coupling device by means of an intermediate connection supported on the stick shaft, which is thus in direct contact with said coupling device and is free from rigid connection with the link arms.

5. A means according to claim 2 wherein said link arms are provided at the ends facing away from the abutment portions with free external support surfaces of predetermined shape, said coupling device being provided with free support surfaces of the same predetermined shape as the free support surfaces of the link arms for intimate cooperation therewith, whereupon the pressure exerted by the locking device is propagated through the link arms and transmitted to the coupling device via said free support surfaces, the distance for transmission of forces generated between implement and operating arm via the stick shaft and the coupling device of the implement being limited to a minimum equivalent to the wall thickness at said free external support surfaces, measured between these support surfaces and the opposing inner surface abutting the stick shaft.

6. A means according to claim 2 wherein said support surfaces of the link arms and the coupling device are arc-shaped and have the same radius, and wherein the centre of the stick shaft and the centre of the coupling device support surface coincide.

7. A means according to claim 6, wherein said coupling device consists of two hooks spaced a predetermined distance from each other, with openings facing the upper surface of the implement, and wherein the shaft support comprises two cylindrical sleeves arranged at the same distance from each other as the distance between the hooks and having said free external support surfaces of the link arms.

8. A means according to claim 3 wherein each link arm is journalled on the shaft by means of a mounting plate provided with a hole and located adjacent to an end of the stick shaft, and is provided with an arc-shaped counter member which by means of a concave support surface abuts directly against the shaft which is thus pressed against the coupling device, the hole in the mounting plate being sufficiently large in relation to the diameter of the stick shaft ends to permit this transmission of pressure to the coupling device via the counter member and the shaft.

9. A means according to claim 8 wherein said shaft and support surfaces of the coupling device are arc-shaped and have the same radius and wherein the center of the shaft and the centre of the support surfaces of the coupling device coincide.

10. A means according to claim 9 wherein said coupling device consists of two hooks spaced a predetermined distance from each other, the hook openings facing the upper surface of the implement.

11. A means according to claim 2 wherein said counter members of the link arms are arranged below and in the vicinity of the operating cylinder shaft.

12. A means according to claim 4, wherein said coupling device consists of two coupling elements spaced a predetermined distance from each other, each provided with an aperture having support surfaces facing the stick shaft and wherein the stick shaft is provided with the intermediate connection means in the form of two pins protruding perpendicularly from the stick shaft, said pins being arranged to assume a coupling position protruding in a direction away from the operating cylinder shaft, the stick shaft thus being brought into indirect engagement with the coupling device by means of said pins, the pins being in engagement with the apertures of the coupling elements.

13. A means according to claim 2 wherein said locking device comprises one or more tension pins arranged to effect said clamping by means of a wedge effect against the free abutment portions of the link arms.

14. A means according to claim 2 wherein said counter members are provided with support surfaces which in extended plane form an acute angle of about 35°–85° with the support surfaces of the abutment portions, while the support surfaces of the counter members in extended plane form an acute angle of from about 10° to about 65° to said centre plane.

15. A means according to claim 2 wherein a substantial part of the abutment portions is arranged below a centre plane extending through the centres of the shafts.

16. A means according to claim 5 wherein the front shaft support of each link arm is provided with a guide means in the form of ring means having an inclined guide surface in relation to the respective coupling device, said guide means being arranged to cooperate with the coupling devices to facilitate connecting of the operating arm attachment means to the coupling device.

17. A means according to claim 11 wherein the link arms are vertically under the operating cylinder shaft.

18. A means according to claim 14 wherein the acute angle in extended plane of the support surfaces of the counter members with the support surfaces of the abutment portions is 50°–60°, while the acute angle in extended plane of the support surfaces of the counter members with the center plane is 30°–60°.

19. A means according to claim 18 wherein the acute angle in extended plane of the support surfaces of the counter members with the center plane is about 45°.

20. A coupling means for detachably coupling a working implement to an excavating machine operating arm having a stick and an operating cylinder, said implement having an upper surface facing the operating arm, with a front edge facing the excavating machine, said coupling means comprising an operating arm attachment means supported by the operating-arm stick and operating cylinder and comprising a stick shaft journalled horizontally at the stick, and also a cylinder shaft horizontally journalled to the operating cylinder, said shafts being parallel and spaced a predetermined distance from each other, said coupling means also comprising an implement supported attachment means and comprising a coupling device and a locking device, by means of which coupling and locking devices the implement supported attachment means is arranged to be detachably coupled to the operating arm attachment means, said operating arm attachment means comprising link means in the form of two link arms journalled at the ends of said shafts by means of shaft supports included in the link arms, each link arm having a free abutment portion protruding as an extension of the link arm in backward direction from the operating cylinder shaft on the side of the operating cylinder shaft facing away from the stick shaft, said link arms and implement supported attachment means comprising counter members cooperating with each other under pressure, said locking device being arranged to exert pressure on the abutment portions of the link arms, thus moving the link arms in the direction of the coupling device through wedge and lever cooperation with said counter members and abutment portions and pressing the operating arm attachment means against the coupling device to produce a permanent, play-free joint between said implement and operating arm, said attachment means of the operating arm being arranged to be pressed against the coupling device by means of said stick shaft, which is thus in direct contact with the coupling device, each said link arm being journalled on the stick shaft by means of a mounting plate provided with a hole and located adjacent to an end of the stick shaft, each said link arm is provided with an arc-shaped counter member which by means of a concave support surface abuts directly against the stick shaft which is thus pressed against the coupling device, the hole in the mounting plate being sufficiently large in relation to the diameter of the stick shaft ends to permit this transmission of pressure to the coupling device via the shaft.

21. A means according to claim 20, wherein the stick shaft and support surfaces of the coupling device are arc-shaped and have the same radius and wherein the center of the stick shaft and the center of the support surfaces of the coupling device coincide.

22. A means according to claim 21, wherein said coupling device consists of two hooks spaced a predetermined distance from each other, the hook openings facing the upper surface of the implement.

23. A coupling means for detachably coupling a working implement to an excavating machine operating arm having a stick and an operating cylinder, said implement having an upper surface facing the operating arm, with a front edge facing the excavating machine, said coupling means comprising an operating arm attachment means supported by the operating arm stick and operating cylinder and comprising a stick shaft journalled horizontally at the stick, and also a cylinder shaft horizontally journalled to the operating cylinder, said shafts being parallel and spaced a predetermined distance from each other, said coupling means also comprising an implement supported attachment means and comprising a coupling device and a locking device, by means of which coupling and locking devices the implement supported attachment means is arranged to be detachably coupled to the operating arm attachment means, said operating arm attachment means comprising link means in the form of two link arms journalled at the ends of said shafts by means of shaft supports included in the link arms, each link arm having a free abutment portion protruding as an extension of the link arm in backward direction from the operating cylinder shaft on the side of the operating cylinder shaft facing away from the stick shaft, said link arms and implement supported attachment means comprising counter members cooperating with each other under pressure, said locking device being arranged to exert pressure on the abutment portions of the link arms, thus moving the link arms in the direction of the coupling device through wedge and lever cooperation with said counter members and abutment portions and pressing the operating arm attachment means against the coupling device to produce a permanent, play-free joint between said implement and operating arm, said attachment means of the operating arm being arranged to be pressed against the coupling device by means of an intermediate connection supported on the stick shaft, which is thus in direct contact with said coupling device and is free from rigid connection with the link arms, said coupling device consisting of two coupling elements spaced a predetermined distance from each other, each provided with an aperture having support surfaces facing the stick shaft and wherein the stick shaft is provided with the intermediate connection means in the form of two pins protruding perpendicularly from the stick shaft, said pins being arranged to assume a coupling position protruding in a direction away from the operating cylinder shaft, the stick shaft thus being brought into indirect engagement with the coupling device by means of said pins, the pins being in engagement with the aperture of the coupling elements.

24. A coupling means for detachably coupling a working implement to an excavating machine operating arm having a stick and an operating cylinder, said coupling means comprising an operating arm supported attachment means and an implement supported attachment means, said operating arm supported attachment means comprising a stick shaft and a cylinder shaft respectively horizontally journalled to the stick and the operating cylinder of the operating arm, said stick and cylinder shafts being parallel and spaced a predetermined distance from each other, said implement supported attachment means comprising a coupling device and a locking device enabling detachable connection of the working implement to the operating arm via its attachment means, the operating arm attachment means including link means comprising two link arms each independently journalled at the ends of said stick and cylinder shafts by shaft supports on the link arms, each link arm having an abutment end portion extending beyond the cylinder shaft in a direction away from the stick shaft and said locking device including pin means proximate to said abutment end portion of said link arms, said pin means having an inclined surface engageable with a correspondingly inclined surface, defined by aperture means fixed to the implement, on forcing said pin means through the aperture of said aperture means, said link means and said implement supported attachment means further having cooperating counter members having mating surfaces downwardly inclined in a direction toward said stick shaft, said operating arm attachment means, on mounting to said coupling device, having its counter member surface in engagement with the surface of the counter member on the implement supported attachment means, said pin means on being forced through said aperture means fixed to the implement exerting a force against said abutment end portion of said link arms thereby forcing the counter member on said operating arm attachment means to move downwardly relative to the counter member on the implement and thereby also forwardly to firmly press the operating arm attachment means against the coupling device to produce a positive connection between said implement and said operating arm.

* * * * *

UNITED STATES PATENT OFFICE

CERTIFICATE OF CORRECTION

Patent No. 4,674,945 Dated June 23, 1987

Inventor(s) FRITIOF HULDEN

It is certified that error appears in the above-identified patent and that said Letters Patent are hereby corrected as shown below:

Column 1, line 11, "swedish" should read --Swedish--; and in column 11, line 37, "and" (second occurrence) to be deleted.

Signed and Sealed this

Ninth Day of February, 1988

*Attest:*

DONALD J. QUIGG

*Attesting Officer*

*Commissioner of Patents and Trademarks*